US006217483B1

(12) United States Patent
Kallassy

(10) Patent No.: US 6,217,483 B1
(45) Date of Patent: Apr. 17, 2001

(54) EXERCISE APPARATUS ADJUSTMENT MECHANISM

(76) Inventor: Charles Kallassy, 4074 S. Better Dr., Dallas, TX (US) 75229

( * ) Notice: Subject to any disclaimer, the term of this patent is extended or adjusted under 35 U.S.C. 154(b) by 0 days.

(21) Appl. No.: 09/152,883

(22) Filed: Apr. 3, 1998

Related U.S. Application Data

(60) Provisional application No. 60/042,675, filed on Apr. 3, 1997.

(51) Int. Cl.[7] ..... A63B 1/00

(52) U.S. Cl. ..... 482/38; 482/41

(58) Field of Search ..... 482/25, 34, 38–42, 482/91, 95, 96, 101, 123, 129, 130, 135; 248/123.11, 125.2, 123.2, 162.2, 280.11; 211/209

(56) References Cited

U.S. PATENT DOCUMENTS

| | | | | |
|---|---|---|---|---|
| 833,167 | * | 10/1906 | Hughes | 248/123.2 |
| 4,620,701 | * | 11/1986 | Mojden | 482/38 |
| 5,253,832 | * | 10/1993 | Bulas et al. | 248/123.11 |
| 5,302,164 | * | 4/1994 | Austin | 482/91 |
| 5,810,702 | * | 9/1998 | Wilkinson | 482/130 |

FOREIGN PATENT DOCUMENTS

| | | | | |
|---|---|---|---|---|
| 841953 | * | 7/1960 | (GB) | 482/38 |

OTHER PUBLICATIONS

AMF American—Physical Education 1984. Catalog pp. 3, 5, 7 & 12 Showing Gymnastic App. w/ Spring Assisted Height Adjustment.*

* cited by examiner

*Primary Examiner*—John Mulcahy
(74) *Attorney, Agent, or Firm*—Darby & Darby

(57) ABSTRACT

An exercise apparatus includes a base and an elongated upright pillar connected to the base. The pillar has a plurality of stop positions therealong. A surrounding member is slidably mounted on the pillar and is sufficiently oversized to permit relative lengthwise slidable movement therealong. An elongated horizontal support bar is fixedly connected to the surrounding member. The horizontal support bar and the surrounding member is moveable between an upper and lower limit positions on the pillar. The surrounding member is selectively fixed to the pillar at the stop positions. The surrounding member slides relative to the pillar between stop positions. A lifting force is applied to the surrounding member by a mechanical lifting aid to assist the surrounding member when sliding relative to the pillar.

4 Claims, 6 Drawing Sheets

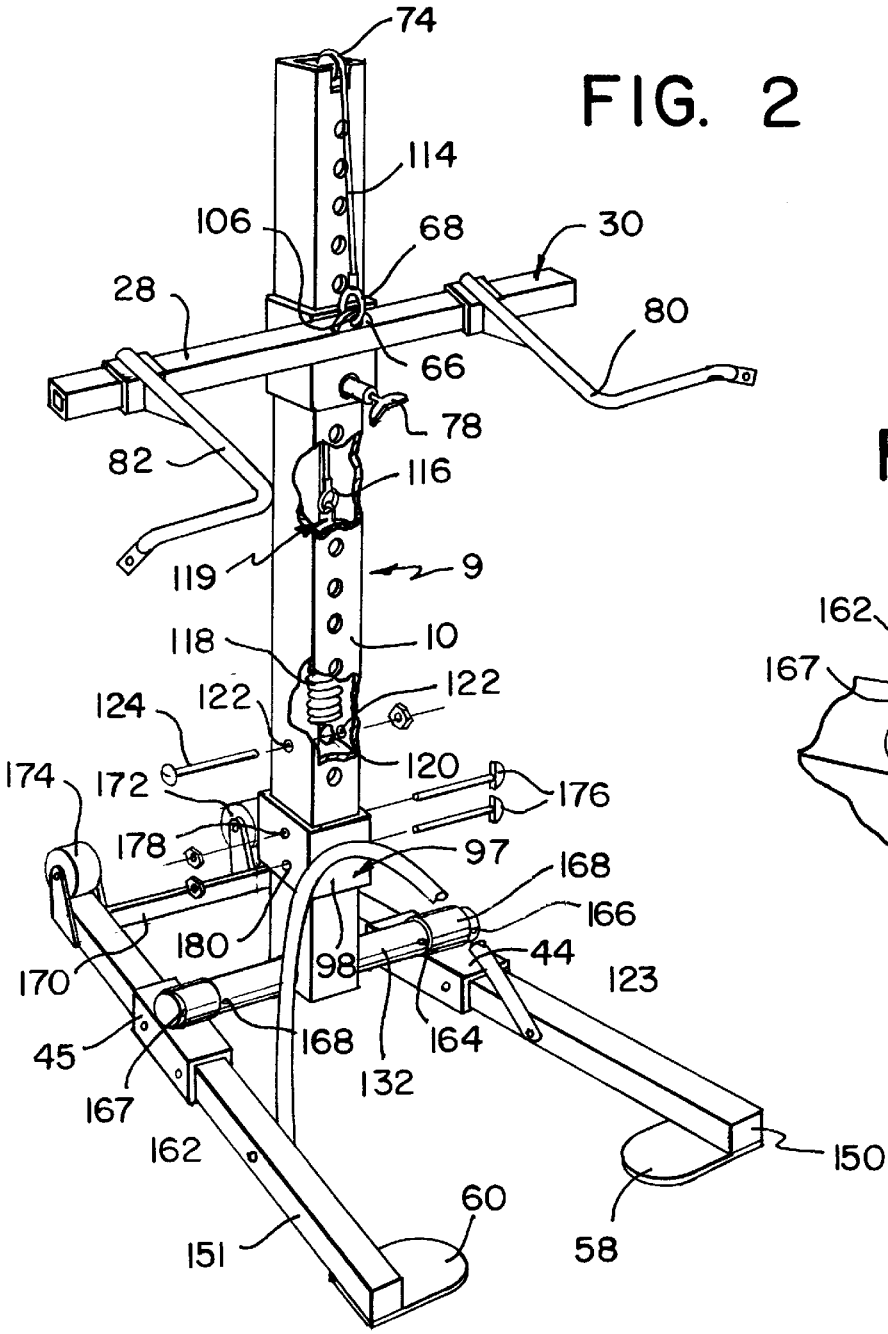
FIG. 2
FIG. 3
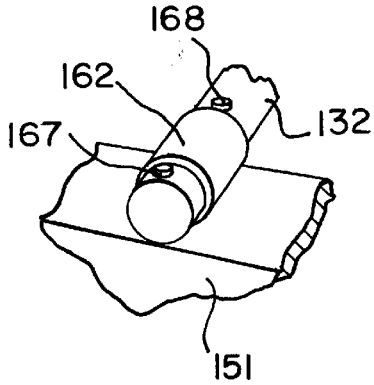
FIG. 5
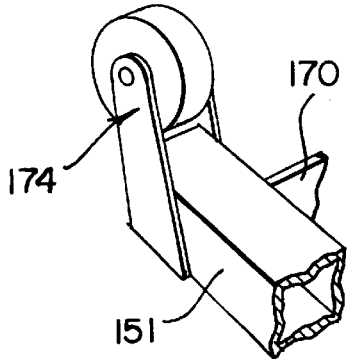

FIG. 7
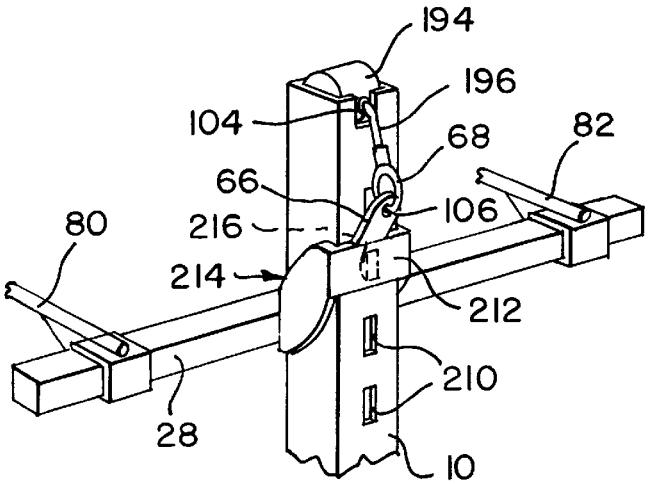
FIG. 11
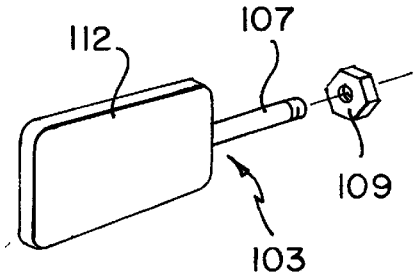
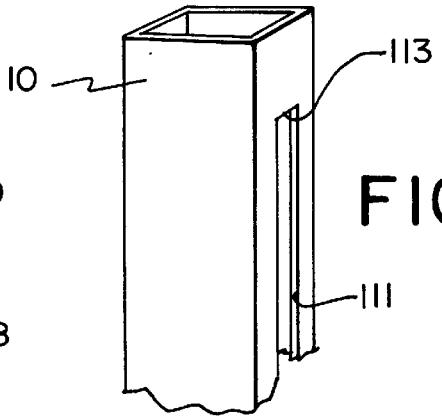
FIG. 12
FIG. 10
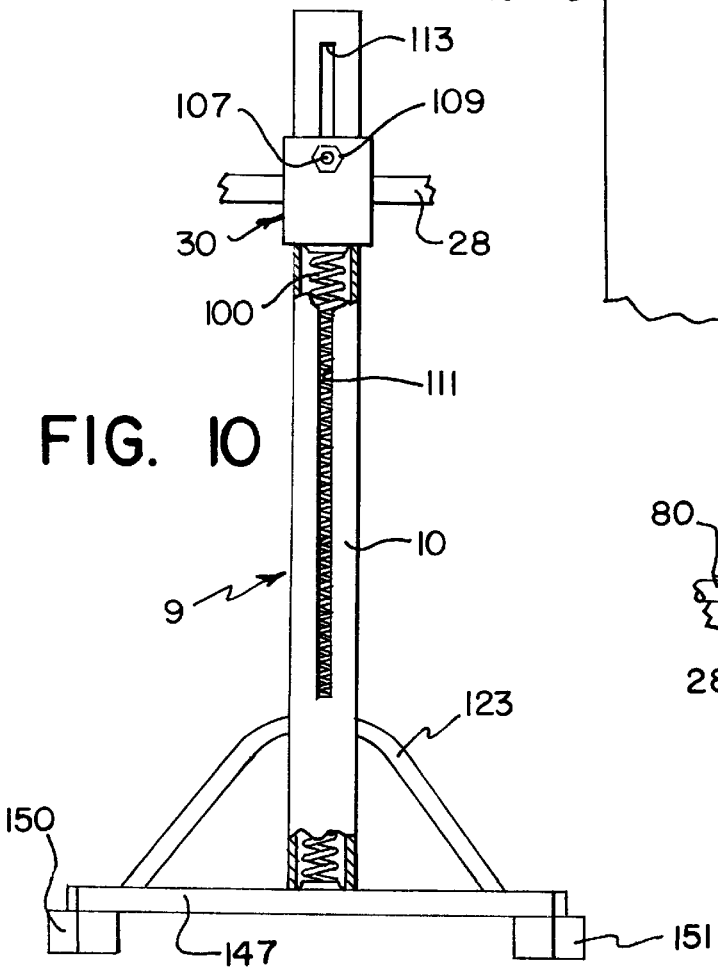
FIG. 13
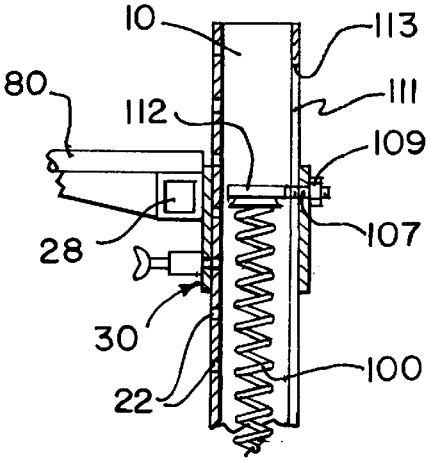

EXERCISE APPARATUS ADJUSTMENT MECHANISM

This application is based upon Provisional Patent Application, Ser. No. 60/042,675 filed Apr. 3, 1997, the entire disclosure of which is hereby incorporated by reference. Applicant claims the benefit of the filing date of the aforesaid provisional application under 35 U.S.C. §119.

BACKGROUND OF THE INVENTION

1. Field of the Invention

This invention relates generally to exercise apparatus, and more particularly to an adjustable apparatus facilitating methods to perform a wide variety of exercises, exercise intensities and optional workout style options generally in the manner of the common exercises known as pull ups, push ups, triceps dips, knee raises and knee bends.

2. Discussion of the Related Art

As disclosed in United States Provisional Patent Application Ser. No. 60/013,959, filed in the U.S. Patent and Trademark Office on Mar. 15, 1996, the disclosure of which is hereby incorporated by reference, and in PCT Application No. PCT/US97/04618, entitled "Exercise Apparatus and Method of Use", which claims priority from the above-identified U.S. Provisional application and was filed on Mar. 14, 1997, the disclosure of which is hereby incorporated by reference, the popularity of exercising and the use of exercise apparatus is increasing. Regular and proper exercise with such apparatus can provide increased muscle tone, strength, conditioning, improved posture and overall conditioning. However, most exercise products do not provide the user with a safe, effective, versatile and affordable means of exercising, and this usually results in short term use of the exercise apparatus and a failure to stick to or maintain a regular exercise program. When an exercise device is insubstantial in its design and awkward to use that is how the exerciser generally feels when using it. In addition, because of the limited exercises possible on many of those apparati, the exerciser is forced to utilize a number of different apparati or impracticably large and expensive multi-station gyms in order to facilitate a full body workout.

SUMMARY OF THE INVENTION

This exercise apparatus utilizes the body's own weight for balanced and effective strength and stretch in the manner described herein. The methods of exercise facilitated by this apparatus provide exceptional toning, shaping of the body and the development of a well balanced and naturally developed physique. Use of the apparatus promotes proper biomechanics. This approach to exercise is achieved, principally, by incorporating the body's innate ability to regulate the correct amount of resistance throughout a full range of motion during exercise. This innate ability is known as the body's proprioceptive or kinesthetic sense. This sense informs the user of the degree to which muscles are contracted, the amount of tension created in tendons, the change of position of a joint and the orientation of the head relative to the ground and in response to movements. It also allows the user to estimate weight and to determine the muscular work necessary to perform a task.

Although it is widely known that exercises like push ups, pull ups and triceps dips are very efficient exercises for overall strengthening and shaping, most people do not have sufficient strength to gain full benefit from these types of exercises. They are only able to achieve a few, if any, repetitions of these difficult exercises without straining. This high intensity low repetition type of exercise has a tendency to build a bulky type of musculature and predispose the exerciser to overuse and injury.

In general, to tone muscles and increase muscular endurance, a lower intensity and higher repetition approach to the exercises is required. However, not everyone can do 12–15 or more push ups, pull-ups or triceps dips in a set, even at a maximum level of exertion. And most would not then be capable of performing the multiple sets necessary in the progression of a well designed strength training program.

With multiple quick, and easy adjustments of the exercise apparatus as disclosed herein, the exerciser is able to regulate the difficulty of each exercise naturally. The simple and efficient exercise programs possible with this apparatus provide variety and the ability to progress, which is important for long term benefits and enjoyment. With its fast, efficient and multiple adjustments, this apparatus adjusts to the exerciser's individual shape, size, physique and desired exertion level thus facilitating effective and enjoyable exercise for all users, from beginner to the advanced.

Good posture is one of the key elements to good health and a positive self image. Posture is one of the first things that others notice about a person and can be a sign of poor health and poor self esteem. Poor posture can result in forward tilt of the head, rounding of the shoulders, compression of the internal organs, unnatural curves of the back, and protrusion of the abdominal area. In addition, the spine is exposed to undo stresses which can contribute to chronic back pain, headaches and fatigue. By improving and maintaining correct posture it is possible to add inches to one's functional height.

For most people there is very little that they do on a regular basis that promotes good posture. People often sit at desks, watch computer screens for hours on end and do little, on a regular basis, in the way of exercise. As the body ages the signs and symptoms of the detrimental effects of these habits and the struggle against the force of gravity become more and more manifest in the area of posture and body alignment. The apparatus described herein and the exercises and exercise programs made possible by its design can provide the exerciser with the option of a full body workout and help to facilitate biomechanically correct workouts. Thereby facilitating the strengthening, lengthening, and realigning the overstretched and weak slouched of the mid-back, and the tight, weak and unbalanced musculature of the chest, arms, shoulders, legs and buttocks. This results in the development of proper posture, flexibility and a natural physique.

In addition, because the adjustments of the machine are quick and do not require the burden of adjusting multiple pins, cams, bands or weight stacks, the exerciser can smoothly transition from exercise to exercise without interruption, thereby providing the opportunity not only for an exercise routine that strengthens, aligns and tones the body but one that provides the option of continuous cardiovascular (aerobic) exercise as well. This aerobic exercise option would generally require the exerciser to reduce the amount of load delivered during the exercises so as not to overexert into the anaerobic phase of exercise. This is inevitable while exercising with high loads, speeds and intensities.

Other devices do not provide for convenient means of adjusting the load and or intensity during exercises. The present machine achieves this by the unique load adjustments, body shape and size adjustments and exercise alignment options made possible by the tensile aided, counterweight aided and or the lever locking pin or pin-less vertical adjustment of the apparatus working in concert with the pin or pin-less horizontal exercise handle width adjustments. This along with the unique integration of the proprioceptive senses to facilitate load and intensity provide the exerciser with instantaneous adjustments without interruption of the exercise or exercise session. It is not uncommon for exercisers to alternate the type, variety and intensity of their workout from one exercise day to another. This apparatus allows the exerciser that option.

This application of this method of exercise can be understood by the following descriptions: In the first case, while performing an exercise with the invention, a pull-up for example, the feet can remain on the ground with the chinning bar handles vertically positioned at such a height so that the complete pull up motion of the arms, full range of motion, can be achieved with the feet remaining on the ground to assist in the pull-up. In an exercise regime where the goal is to perform 15 pull up repetitions, by the 15th repetition of a set the exerciser can deliver the exact amount of arm resistance needed through leg assistance, without changing heavy weight plates. Additionally, in an exercise regime where the goal is to perform 15 leg squat repetitions, throughout a set and by the 15th repetition of a set the exerciser can deliver the exact amount of leg resistance needed through arm assistance, without changing heavy weight plates.

Many of the exercises that are made possible with this apparatus, supported pull ups and supported triceps dips for example, are compound exercises that involve more than one joint. Compound exercises, in general, more accurately emulate natural day-to-day use of the body and greatly increase the efficiency and enjoyment of exercising.

The invention disclosed herein is, therefore, a variety of unique means by which to aid in the vertical adjustment of an exercise device and a unique method by which to fold a single station exercise device with a single adjusting assembly allowing multiple adjustments that facilitates multiple supported and unsupported exercises for easy storage and portability.

As previously stated, several of the features of my invention are the variety of unique means by which to aid in the vertical adjustment of an exercise device. The method of achieving such aid as taught herein generally could include an elastic band, a spring or a cord that has exerted on it some form of tensile resistance much as does a retractable dog leash or retractable tape measure and would provide enough tensile aid so as to effectively reduce the weight of the vertical adjustment assembly as it is relocated along the length of the upright pillar of the apparatus causing the vertical adjustment assembly to effectively glide as it is being relocated along the pillar.

It is common in the exercise products industry to utilize a pin into a hole to adjust vertical height in some exercise equipment. Although the use of such a pin into a hole adjustment is by reference, included in the scope of the apparatus, the use of a pin or plurality of pins is not required.

A problem with using a conventional pin locking system for the vertical adjustment in an exercise apparatus such as this for example, is that once the pin is removed if the pin is not placed correctly or if the user releases the device before re-pinning, the device to be adjusted can slide to the floor exposing the user to potential harm. The use of a spring loaded pin as is so known to those familiar with the art, can be incorporated to reduce the possibility of such unwanted sliding however, this method of adjustment can be encumbering to the exerciser and can necessitate an undesirable and inefficient pause in some exercises and exercise routines.

Another important aspect of this invention is a unique method by which to fold a single station exercise device facilitates multiple supported and unsupported exercises for easy storage and portability.

In one embodiment of the apparatus, the upright vertical member and portions of the frame are formed of square material.

While the invention will be described in connection with United States Provisional Patent Application Ser. No. 60/013,959, filed in the U.S. Patent and Trademark Office on Mar. 15, 1996, the disclosure of which is hereby incorporated by reference, and a number of preferred embodiments, it should be understood that this description is not intended to limit the invention to this reference or these embodiments. On the contrary, it is intended to cover all alternatives, modifications and equivalents as may be within the spirit and scope of the invention and would be so obvious to those skilled in the art.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 2 is a perspective view of the exercise apparatus;

FIG. 3 is an enlarged partial perspective view of the end of the base cross member;

FIG. 5 is an enlarged partial perspective view of the wheel assembly;

FIG. 7 is an enlarged partial perspective view of the upper end of the pillar showing a modification of the apparatus in accordance with the present invention;

FIG. 10 is a rear view of another modification of the mechanically aided lifting device;

FIG. 11 is a perspective view of a spring compression tab assembly;

FIG. 12 is a partial perspective view of the upper portion of the pillar;

FIG. 13 is a partial side view of the upper portion of the pillar;

DETAILED DESCRIPTION OF THE PREFERRED EMBODIMENT

Figure 1:
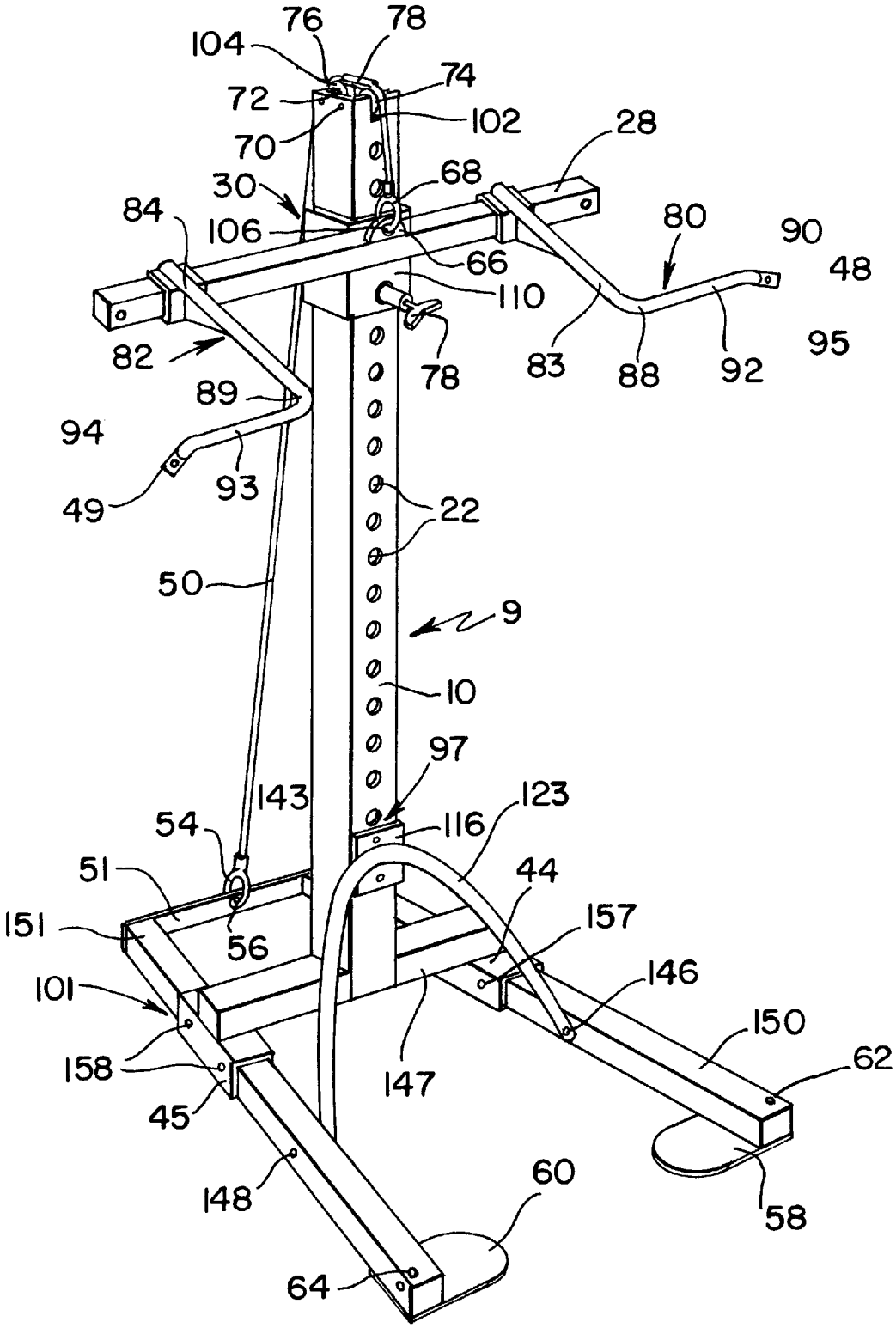
FIG. 1 is a perspective view of the mechanically aided exercise apparatus in accordance with the present invention.

Shown in FIG. 1 is a first embodiment of the mechanically aided exercise apparatus 9. In general, this apparatus can be considered to include a pair of horizontally oriented handle members 80 and 82. These handle members consist of elongated members 83 and 84, which are parallel to one another projecting forward; continuing with radius bends 88 and 89 turning outward generally at right angles and away from the midline; continuing with members 92 and 93, that project laterally from the midline and are oriented substantially parallel to the ground and perpendicular to elongated members 83 and 84; continuing to downward radius bends 90 and 94, pointing downward at an angle of approximately 30 degrees; continuing and terminating with members 95 and 96 sloping downward at approximately 30 degree angles to the ground. Bored into the terminal ends of members 95 and 96 are elastic cord clip receptacle bores 48 and 49. The length of members 83 and 84 should be such that their vertical plane of members 92 and 93 is rearward of the vertical plane of the distal ends of base members 150 and 151.

Elongated members 83 and 84 extend forward from a horizontal supported bar 28 in a cantilevered arrangement. The horizontally disposed bar 28 is rigidly attached in this embodiment for example by a weldment arrangement, to sleeve 110 which is of such a dimension so as to allow the free sliding of itself and subsequently the entire pin locking mechanically aided vertical height adjustment mechanism assembly 30 to which it is rigidly attached, along the length of centrally located, vertically oriented pillar member 10 onto which sleeve 110 is slidably mounted.

Pillar 10, base assembly 101 and bar 28 can be formed of any suitable material. For example, pillar 10 and base assembly 101 can be formed of three inch round steel tubing, two inch square or two inch by three inch rectangular, oval or triangular columnar steel lengths, and bar 28 could be of one inch square or one inch by two inch rectangular columnar steel.

However, in some cases the selected material will dictate the use of the vertical adjustment mechanism modifications corresponding to the selected material as previously taught in my United States Provisional Patent Application Ser. No. 60/013,959, filed in the U. S. Patent and Trademark Office on Mar. 15, 1996.

In a preferred embodiment of the apparatus, the pillar 10 is formed of three inch square steel tubing.

To insure that the pillar 10 can maintain support when subjected to the moment created by the cantilevered action of handles 80 and 82, especially with the weight of an exerciser thereon, the pillar 10 is continuous with or rigidly attached to base assembly 101; interconnector buttress support 123 is securely attached at its terminal ends by mounting and pivot axis bolts and nut attachments 146 and 148 to base members 150, 151 respectively and such nut and bolt attachment will provide a pivot for interconnector buttress support 123 when folding of the frame is desired and as will be taught below. Interconnector buttress support 123 is rigidly connected at its midpoint by weldment arrangement to connector plate 116, formed of flat or in this embodiment angled steel which is of a dimension so as to fit onto or snugly accept the outer dimension of base end of pillar 10 at location 97 and can be attached by screwmount attachment through bores 143 corresponding to aligning bores in pillar 10 at location 97.

Pillar 10 is rigidly attached, such as by weldment arrangement, at its base end, to the center of base cross member 147. Rails 150 and 151 are rigidly attached to base cross member 147 by weldment arrangement or in this case, where a disassembling is desired, by connectors 44 and 45, formed of angled steel, which are rigidly attached to the terminal ends of base cross member 147 and attached by a nut and bolt attachment to rails 150 and 151 through bore sets 157 and 158 and their corresponding aligning bores on rails 150 and 151.

Connector anchor bar 51 is rigidly attached to the rear most ends of rails 150 and 151 respectively and has at its mid point bore 56 which is of such a dimension so as to accept connector ring 54. Ring 54 is attached to elastic cord 50 in a manner that is known to those skilled in the art.

Bore sets 62 and 64 are disposed at the forwardmost ends of rails 150 and 151 respectively and are of such a dimension so as to freely accept the clip end of an elastic cord assembly 66 that is known to those skilled in the art. Foot plates 58 and 60 are rigidly connected to the forwardmost ends of rails 150 and 151 and are attached in a manner such as a weldment attachment. These foot plates are stood upon by the user when using elastic cord assembly 66 to perform an exercise such as a biceps curl exercise and prevent undesirable lifting of the apparatus 9.

So as to provide the free and unrestricted movement of and proper alignment of elastic cord 50 a pulley system is incorporated, in this case the use of two pulleys 74 and 76. Pulleys 74 and 76 are of a type that is known to those skilled in the art. Pulleys 74, 76 are disposed at the topmost end of pillar 10 and are of such a size so as to freely accept the dimension of elastic cord 50 into their respective grooves. Pulleys 74 and 76 are in this case, mounted to the inside of pillar 10 by means of bolt and nut fasteners 124 which are of such a length that when inserted into bores 70 and 72 disposed in alignment with their mirror bores on the opposite sides of the upward end of pillar 10 and through the registered and aligning center axis bores of pulleys 74 and 76 extend completely through pillar 10 and provide full thread attachment of nuts. Cord lock rod 78 is disposed at the topmost end of pillar 10 in such a manner so as to resist the disengaging of elastic cord 50 from the grooves of pulleys 74 and 76. Notch 102 and its mirror, notch 104, are disposed at the top of the front and back sides of pillar 10 and are aligned in such a relationship with pulleys 74 and 76 so as to allow the pulleys to be somewhat recessed into the top of pillar 10 and, thus, allows the free and unobstructed movement of elastic cord 50 thereby reducing the vertical height of the apparatus 9.

Connector ring 68 is attached to the upper terminal end of elastic cord 50 in any manner that is known to those skilled in the art. Connector tab 66 is rigidly attached to one of the sides of sleeve assembly 30, in this embodiment to the mid point of horizontal supported bar 28 by weldment arrangement, and includes bore 106, which is of such a dimension so as to receive connector ring 68. Elastic cord assembly 108 is of such a length and tensile resistance so that when attached to bores 56 and 106 and disposed so as to freely glide over pulleys 74 and 76 it exerts a lifting force on pin locking mechanically aided vertical height adjustment mechanism assembly 30 thereby aiding in quick and smooth transitions between various vertical height positions along the length of pillar 10.

Sleeve 110 has mounted to one of its sides, in this case the front, spring loaded adjusting pin assembly 78, a pin assembly that is known to those skilled in the art. The central shaft of pin assembly 78 is of such a shape so as to freely seek and insert into bores 22 which are disposed along the vertical length, in this case down the front, of pillar 10. Such a relationship provides a locking mechanism that prevents unwanted sliding of pin locking mechanically aided vertical height adjustment mechanism assembly 30 down the length of pillar 10.

Turning now to FIG. 2. In accordance with yet another aspect of the invention, as it is foreseeable that some users of the apparatus 9 may desire a means of conveniently folding the apparatus, described below is an embodiment of the apparatus that includes a unique means via a pivot folding configuration by which to fold the frame of apparatus 9. Although only one embodiment is taught below it should be understood that this description is not intended to limit the invention to this reference or this embodiment. On the contrary, it is intended to cover all alternatives, modifications and equivalents as may be within the spirit and scope of the invention and would be so obvious to those skilled in the art.

Base cross member 132 is formed of a circular steel tube that is rigidly attached to the base end of pillar 10 by weldment arrangement at the mid point of base cross member 132. Each corresponding end of base cross member 132 is of such a dimension so as to fit snugly into sleeves 160 and 162 respectively yet still allow free rotation of base cross member 132. Sleeves 160 and 162 are rigidly attached to connectors 44 and 45 by weldment arrangement. Rear base cross member 170 is rigidly attached at it terminal ends to the rearward terminal ends of base members 150 and 151 and is attached by weldment arrangement but can be attached by means of a common bolt and nut configuration if more compact shipping of the apparatus 9 is desired. Wheel assemblies 172 and 174 are of the type known to those skilled in the art and are attached to the rearward terminal ends of base rails 150 and 151 by weldment arrangement. Connector bracket 98 is formed of angled steel which is of a dimension so as to snugly accept the outer dimension of pillar 10 at frame support position location 97 and is securely attached to pillar 10 by knobbed bolt and nut fasteners 176 which are of such a length that when inserted into bores 178 and 180 on connector bracket 98 and through registered and aligning bores 186 and 188 through the mirror bores of bores 186 and 188 on pillar 10 and through the mirror bores of 178 and 180 and they extend completely through plate connector bracket 98, pillar 10 and provide full thread attachment of nuts.

There is disclosed yet another such modification of the apparatus here in FIG. 2, the front end of cord 114 is attached to connector ring 68 in any manner that is known to those skilled in the art and is in turn attached to tab 66 at bore 106. The back end of cord 114 is attached to connector ring 116 in any manner that is known to those skilled in the art. Cord 114 passes over and engages pulley 74 and connector ring 116 is now disposed down into the inside of pillar 10 where it is attached to the top end of spring 118 by any such means that is known to those skilled in the art. Spring 118 is disposed inside pillar 10, at a lower most portion thereof. Connector ring 120 is attached to a lower most end of spring 118 and is in alignment and registration with bore 122 that is disposed through both parallel sides of pillar 10. Bolt and nut fastener 124, which is of such a length that when inserted into bore 122 and through registered and aligning connector ring 120 and then through bore's 122 mirror bore and then extends completely through pillar 10 to provide full thread attachment of nuts. Spring cord assembly 119 is of such a tensile resistance so as to exert, via its connection to assembly 30 at tab 66, sufficient mechanical aid to the lifting of assembly 30 throughout the vertical adjustment length of pillar 10.

In FIG. 3 nubs 164 and 168 are disposed at each end of base cross member 132 respectively in such a manner so as to border the inner edge of sleeves 160 and 162 respectively so as to prevent unwanted horizontal sliding of base cross member 132 in sleeves 160 and 162. Similarly, nubs 166 and 167 are disposed at each end of base cross member respectively in such a location so as to border the outer edge of sleeves 160 and 162 respectively so as to prevent unwanted horizontal sliding of base cross member 132 in sleeves 160 and 162. Nubs 164, 168, 166 and 167 are attached in a screwmount arrangement.

Figure 4:
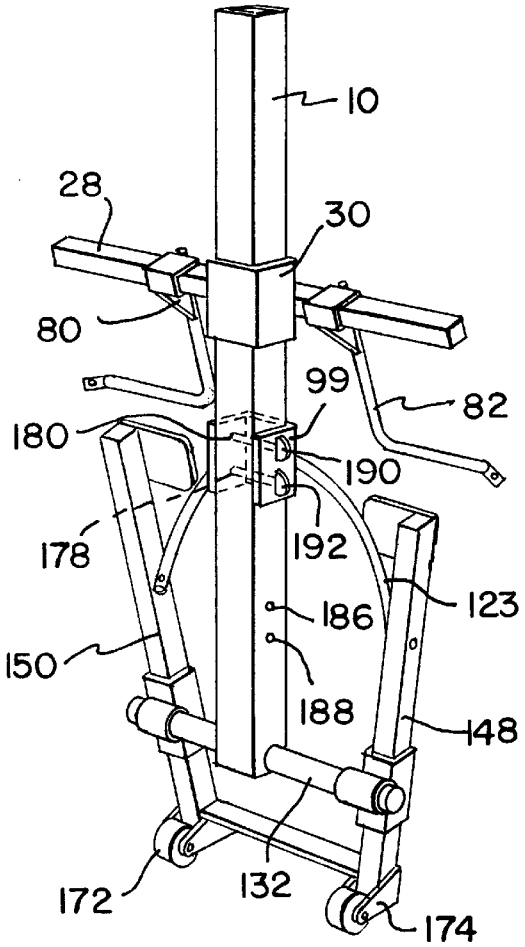
FIG. 4 is a perspective view of the apparatus shown in a folded configuration.

In FIG. 4 the apparatus is shown in its folded arrangement. Handle members 80 and 82 have been removed and relocated from their horizontal orientation to a vertical apparatus folding and storage orientation; knobbed bolt and nut fasteners 176 have been removed from their frame support position at location 97; connector bracket 98 has been moved to frame folded and cached position at location 99; interconnector buttress support 123, via its weldment attachment to connector bracket 98 and the pivot action of mounting and pivot axis bolts and nut attachments 146 and 148 is now in its frame folded and cached alignment; pillar 10 has been rotated via the pivot axis of base cross member 132 and its relationship with sleeves 160 and 162; pillar 10 now in its frame folded and cached position and is now generally parallel to base rails 150 and 151; knobbed bolt and nut fasteners 176 have been inserted into bores 178 and 180 and extend through bracket 98; through registered and aligning bores 190 and 192 on pillar 10, and extend completely through plate connector bracket 98, pillar 10 and therefore provide full thread attachment of nuts thus securing the apparatus in its folded and cached position. Apparatus 9 can now be easily moved to any convenient storage location by holding the upper end of pillar 10 and rolling the apparatus on the wheel assemblies 172 and 174 which can now engage the floor.

Figure 6:
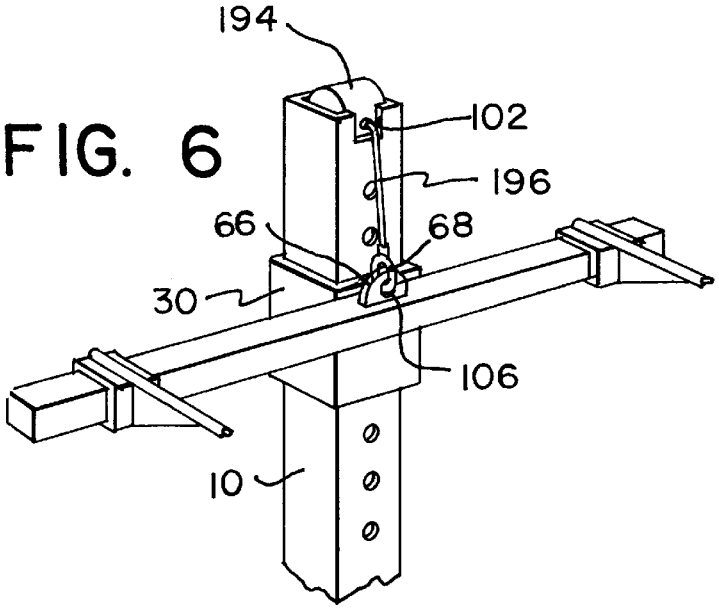
FIG. 6 is an enlarged partial perspective view of the upper end of the pillar.

Turning now to FIG. 6. Shown here is a modification of the mechanically aided lifting assembly. Retractable cord assembly 194 is mounted to the inner surface of the upper end of pillar 10 in a screwmount arrangement and is a retractable cord device such as is employed in the use of a retractable dog leash or retractable tape measure, which are known to those skilled in the art. Cord 196 is attached to connector ring 68 in any manner that is known to those skilled in the art, and is of such a length and under such a tensile resistance that when said cord is connected to mechanically aided vertical height adjustment mechanism assembly 30, via its attachment to bore 106 of connector tab 66, there is exerted a lifting force that aids in the lifting of assembly 30 throughout its entire vertical adjustment range on pillar 10.

In FIG. 7, there is disclosed yet another such modification of the apparatus. Pillar 10, has disposed down and along its length on its rear, evenly spaced vertical adjustment locking holes 210. Holes 210 can be of round, square or other shape. Vertical locking section 212 is rigidly attached, by weldment arrangement or other secure means, to the inside and topmost rear area of both parallel sides of sleeve assembly 214 and is oriented in a generally horizontal position clearly above the horizontal plane of bar 28, thereby allowing for the rockering action of the sleeve assembly mechanism. Locking section 212 has projecting from it's inner surface shown in phantom is lock nub 216. Nub 216 is formed of steel or other like material and is rigidly fixed to the inner surface of section 212 by a weldment arrangement or other secure means. Tab 216 is of such size and shape that, when in the locked position it engages into a hole 210 and thereby locks the sleeve assembly 214 into a locked position, thus preventing undesired downward migration of the assembly. Although the drag and friction created on the contact surface of pillar 10 by the rockering action of sleeve assembly 214 can be adequate to resist downward migration of the assembly to insure a secure hold a locking mechanism, such as described herein, is preferably employed. Sleeve 256 is of a size and shape so as to conform to pillar 10 yet allow free movement over pillar 10 during vertical position adjustments.

Retractable cord assembly 194 as disposed at the top end of pillar 10 is in this modification rearward facing. Cord 196 is attached to connector ring 68 in any manner that is known to those skilled in the art, and is of such a length and under such a tensile resistance delivered by retractable cord assembly 194 that when cord 196 is connected to mechanically aided vertical height adjustment mechanism assembly 214, via its attachment of connector ring 68 to bore 106 of connector tab 66, there is exerted a lifting force that aids in the lifting of assembly 214 throughout its entire vertical adjustment range on pillar 10.

Figure 8:
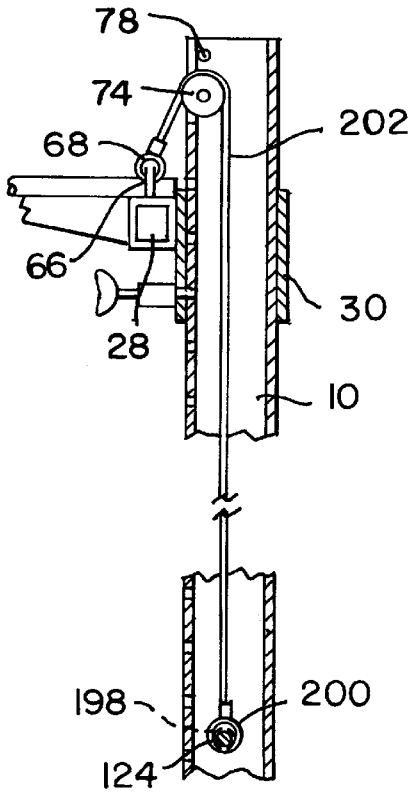
FIG. 8 is a partial side view of the upper portion of the pillar.

Shown in FIG. 8 is another modification of the mechanically aided lifting apparatus. Elastic cord 202 is attached to connector ring 68 in any manner that is known to those skilled in the art and is in turn attached to tab 66 at bore 106. Elastic cord 202 passes over pulley 74 and down into the inside of pillar 10. The base end of elastic cord 202 is attached to connector ring 200 and is disposed down inside pillar 10 to a point that connector ring 200 is in alignment and registration with bore 198 that is through both parallel sides of pillar 10. Bolt and nut fastener 176 which is of such a length that when inserted into bore 198 and through registered and aligning connector ring 200, extend completely through pillar 10 and provide full thread attachment of nuts. Elastic cord 202 is of such a tensile resistance so as to exert, via its connection to assembly 30, sufficient mechanical aid to the lifting of assembly 30 throughout the vertical adjustment length of pillar 10.

Figure 9:
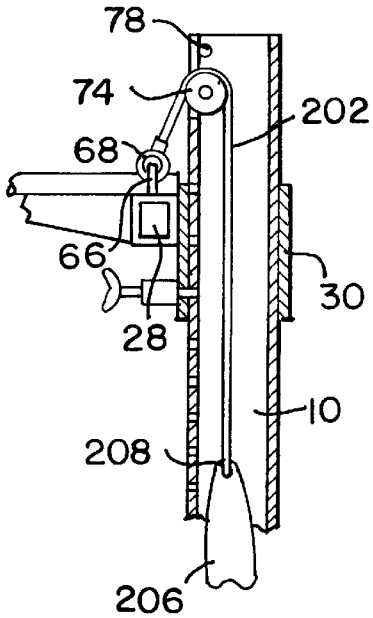
FIG. 9 is a partial side view of the upper portion of the pillar showing a further modification of the mechanically aided lifting apparatus.
Figure 14:
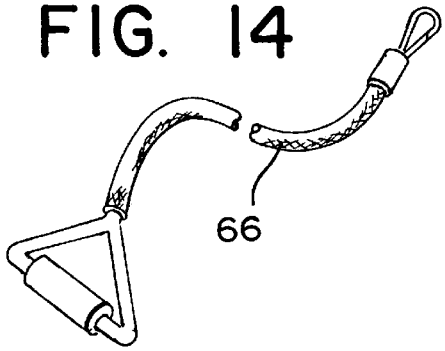
FIG. 14 is a perspective view of an elastic cord assembly.

Directing your attention now to FIG. 9, shown here is another modification of the mechanically aided lifting apparatus. Cord 204 is attached to connector ring 68 in any manner that is known to those skilled in the art and is in turn attached to tab 68 at bore 106. Cord 204 passes over pulley 74 and down into the inside of pillar 10. The end of cord 204 is laced through bore 208 which is disposed at the top of counterweight 206. Counterweight 206 is of such a dimension so as to move freely in a vertical manner inside the dimension of pillar 10 and is of such a weight so as to, via its connection to assembly 30, provide sufficient mechanical aid to the lifting of assembly 30 throughout the vertical adjustment length of pillar 10.

Turning now to FIGS. 10–13. Shown here is another aspect of a modification of the mechanically aided lifting apparatus. Spring 100 is inserted down and into pillar 10 and rests securely on the top surface of base cross member 147. Spring 100 is of such a dimension so as to move freely within the inner dimension of pillar 10.

Shown in FIG. 11 is spring compression tab assembly 103. Tab 112 is formed of plate steel and is of such a width so that when horizontally aligned can move freely within the inner dimension of pillar 10 yet large enough to serve as a compression tab to spring 100. Tab 112 has welded to its edge threaded shaft 107.

Shown in FIG. 12 is bored track 111 which is disposed down the backside of pillar 10 and is of such a dimension so as to freely accept threaded shaft 107. Track 111 ends somewhat before the top end of pillar 10 creating stop edge 113 of pillar 10.

Shown in FIG. 13 is spring compression tab 103 having been inserted into and through track 111 from the inside out with the threaded end of shaft 107 projecting rearward and outside of pillar 10. Shaft 107 is of such a length that when inserted through track 111 extends completely through pillar 10 and provide full thread attachment of nut 109 thus rigidly attaching tab assembly 103 to sleeve 110. With the downward adjustment of mechanically aided vertical height adjustment mechanism assembly 30 spring 100 is compressed by tab 112 and spring 100 creates such compression that there is exerted an adequate lifting force on pin locking mechanically aided vertical height adjustment mechanism assembly 30 to aid in quick and smooth transitions between various vertical height positions along the length of pillar 10.

Figure 15:
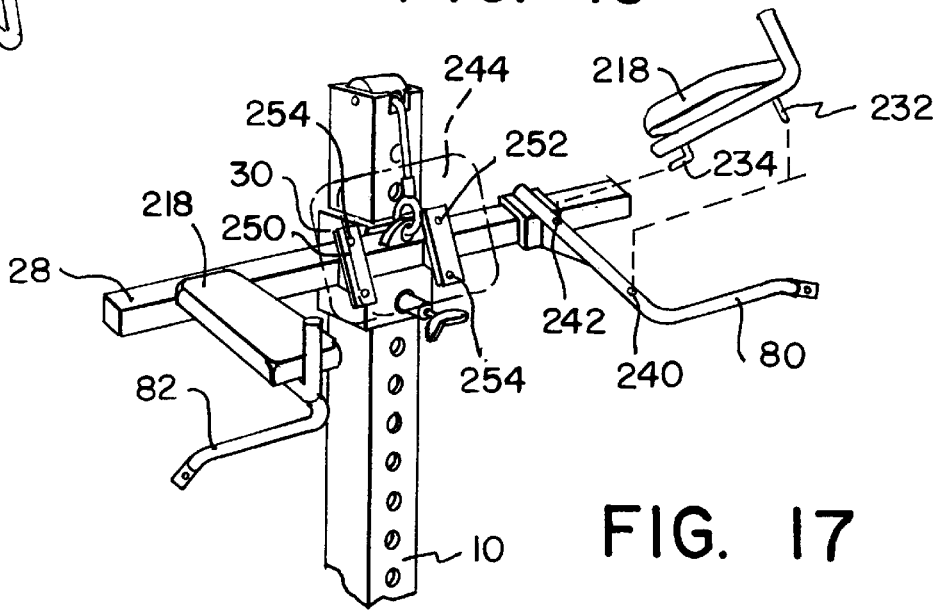
FIG. 15 is a partial perspective view of the upper portion of the pillar showing the forearm pad assemblies.
Figure 17:
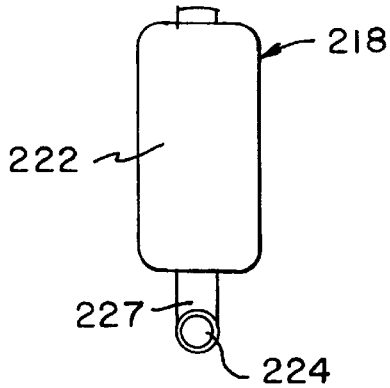
FIG. 17 is a top view of the forearm pad assembly.
Figure 16:
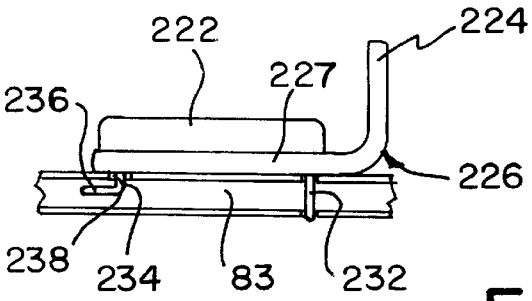
FIG. 16 is a partial side view of the forearm pad assembly.
Figure 18:
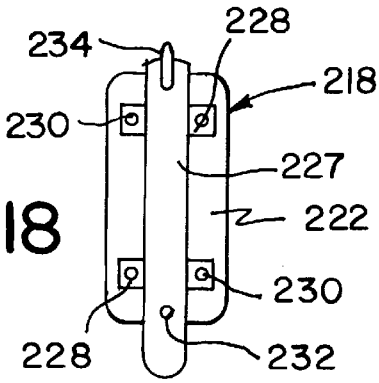
FIG. 18 is a bottom view of the forearm pad assembly.
Figure 19:
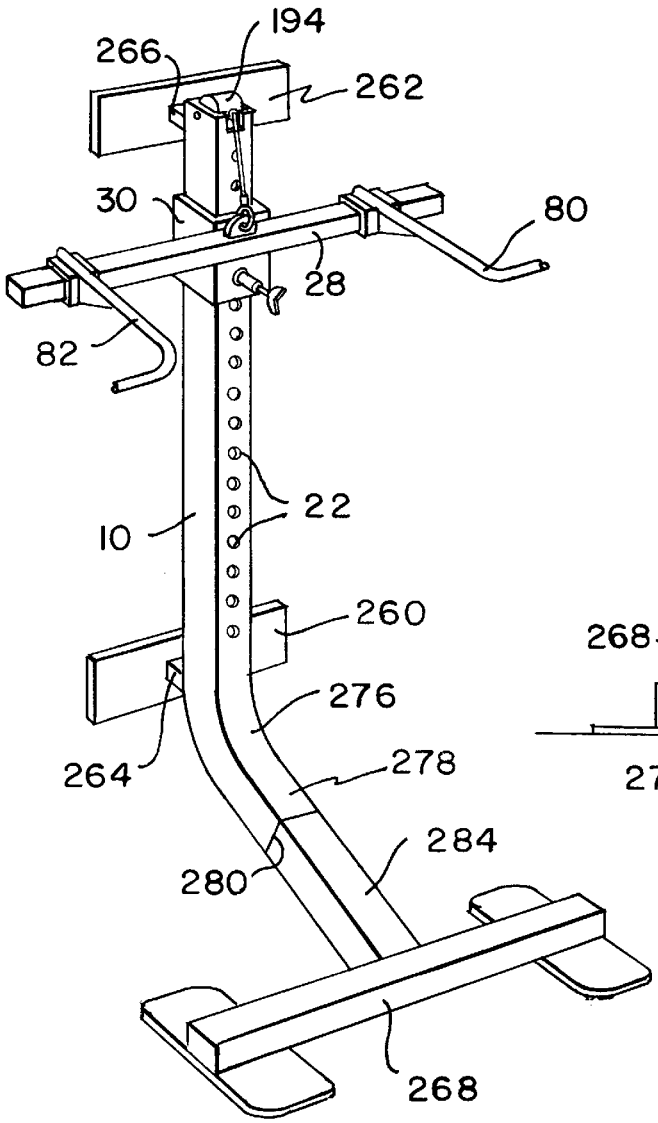
FIG. 19 is a perspective view of another embodiment of the mechanically aided exercise apparatus in accordance with the present invention.
Figure 20:
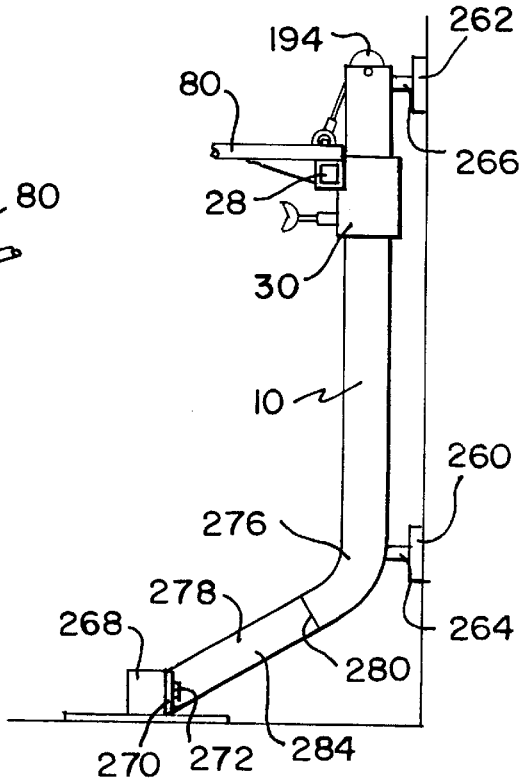
FIG. 20 is a side view of the exercise apparatus illustrated in FIG. 19.
Figure 22:
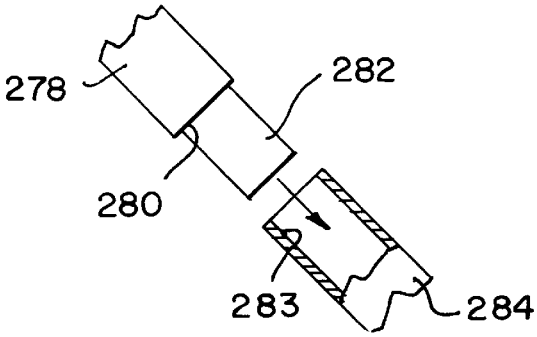
FIG. 22 is a partial side view of the connection between two of the bars of the apparatus shown in FIG. 19.
Figure 21:
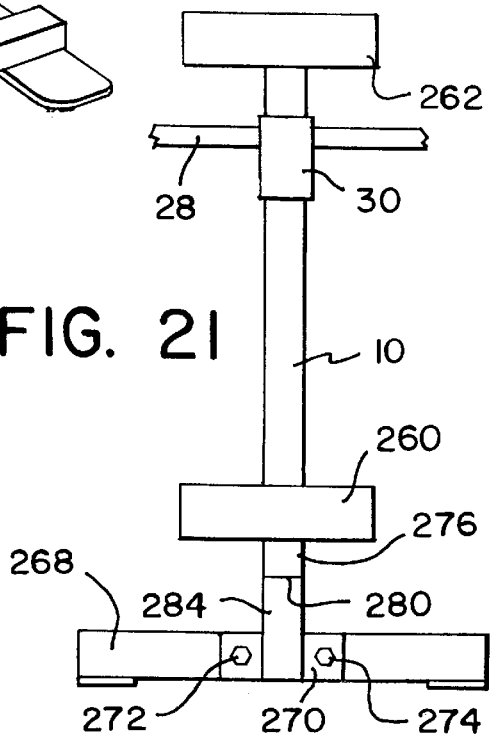
FIG. 21 is a rear view of the exercise apparatus shown in FIG. 19.

Turning now to FIG. 15, a pair of forearm pad assemblies 218 have a pad base 220 formed of a rigid wood, metal, plastic or like material, which has fixed to their top surface, in any manner known in the art, soft foam like pad 222. These pads 222 can have a flat top surface or can be concave longitudinally so as to provide a more comfortable resting surface for the forearm. Hand grip assembly 226, is rigidly fixed to pad base 220 in any such manner as is known to those skilled in the art. Such as by a screwmount arrangement as shown in FIG. 18 with screws inserted through bores 230 on brackets 228 and into pad base for secure assembly. Referring once again to FIG. 15, a pair of pad assemblies 218 are shown, one mounted in its locked functional position on handle 82 and one shown in its removed position over handle 80. Forearm pad 218 is shown with handle 224 end oriented forward, and locked upon, the approximate length of elongated member 84, by means of forearm pad to handle rod 232 and angled forearm pad to handle rod 234, so that the user's forearms can be securely rested upon the pads. Forearm pad to handle rod 232 and angled forearm pad to handle rod 234 are formed of steel and are attached to the bottom of handle grip support rail 227 in a weldment arrangement or other conventional means. Hand grips length 224 is oriented upward at a 90° angle so as to be in a position to be held in the user's hands to facilitate comfortable performance of knee raises and other like exercises.

When certain other exercises are to be performed and the elongated members 83 and 84 are required to support the hands, it is necessary to remove the pads 218 as is shown with pad assembly 218 removed from elongated member 83 and above handle 80.

In accordance with yet another novel aspect of the invention, forearm pads 218 are removable. To remove the pads 218, the front end of the pad assembly 218 is lifted thereby removing rod 232 from bore 240 which is disposed at the forward end of elongated members 83 or 84 and is bored completely through the diameter of elongated members 83 and 84; now the pad assembly 218 can be lifted in a forward direction thereby removing angled forearm pad to handle rod 234 from its position inside of elongated members 83 or 84 with elongated member 236 inside of, rearward facing and parallel with the elongated members 83 or 84.

In accordance with yet another aspect of the invention, as best seen in FIG. 15, a back support pad assembly 244, illustrated here in transparent form, is provided. Pad base 246, formed of a rigid wood, metal, plastic or like material, has fixed to its front surface, by any means known to the art, a soft foam-like pad 248. A pair of plates 250, formed of steel, are rigidly fixed, and mirror each other, to the parallel sides of sleeve 110 by a weldment arrangement or other secure means; pad attachment bracket 252 is continuous with the forward edge plate 250 and oriented at a 90° angle diagonally outwardly. Pad base 220 is attached to bracket 252 in a common screwmount fashion through bores 254.

The angle of the pad also provides a comfortable and safe position for the lower back while performing knee raises and other like exercises and are used in concert with the forearm pads 218 to provide comfort and support while performing knee lift exercises that are known to those skilled in the art.

Turning know to FIGS. 19–22, another embodiment of the present invention is illustrated. The mechanically aided exercise apparatus 9 illustrated in this embodiment is intended to rest against the floor by horizontal bar 268 and against an upstanding wall, which is typically perpendicular with respect to the floor, through substantially vertically oriented mounting pads 260, 262 each of which is fixedly connected to pillar 10. For example, pad 260 is fixedly connected to pillar 10 essentially adjacent to the radius bend 276 by connecting rod 264. Likewise, pad 262 is fixedly connected to the upper portion of pillar 10 by connecting rod 266. Pin locking mechanically aided vertical height adjustment mechanism assembly 30 can be made by any of the embodiments described herein. Pillar 10 is connected to horizontal bar 268 by a selectively disconnectable connection between bar 284 and bar 278 for ease of assembly and disassembly of the apparatus and for small shipping size. More specifically, bar 278 includes a reduced stepped portion 282 that is matingly received within a blind bore 283 in bar member 284. Bar 284 is fixedly connected to horizontal bar 268, preferably by a weldment or a bolt connection (See FIG. 21). As illustrated, reduced portion 282 and blind bore 283 have a correspondingly similar shape in cross section (illustrated as being square) to assure a mating connection between these two parts. Of course, if desired a set screw or other mechanism may be used to selectively lock the connection between bar 278 and bar member 284.

The individual component differences of the mechanical lifting aids to a sleeved exercise device, modified base assemblies, pin locking mechanically aided vertical height adjustment mechanism assemblies and lever locking vertical height adjustment mechanism assemblies as shown and described herein, and the obvious variations not shown, but obvious to those skilled in the art, can be interchanged with one another in whole or in part and in numerous variations and combinations. It should, therefore, be noted that only preferred embodiments of the invention have been illustrated and described. It is realized that various modifications of the described embodiments are possible without departing from the aspect and scope of the invention. For example, the connection of the connector ring 68 on the end of the cord assembly to the horizonal bar 28 through connector tab 66 can be effected to the sides of the pillar or in back of the pillar.

I claim:

1. An exercise apparatus comprising:

a base;

an elongated upright pillar connected to said base, said pillar having a plurality of stop positions therealong;

a surrounding member slidably mounted on said pillar and being sufficiently oversized to permit relative lengthwise slidable movement therealong;

an elongated horizontal support bar fixedly connected to said surrounding member, said horizontal support bar and said surrounding member being movable between upper and lower limit positions on said pillar, said surrounding member being selectively fixed to said pillar by a pin at said stop positions, said surrounding member sliding relative to said pillar between stop positions;

a handle attached to said horizontal support bar; and means for applying a lifting force to said surrounding member to assist said surrounding member when sliding relative to said pillar, said applying means including an elastic cord connected to said base and to said surrounding member and a grooved guide which receives and guides the movement of the elastic cord connected to the top of the pillar.

2. The exercise apparatus according to claim 1, wherein said applying means further includes a pulley being rotatably connected to said pillar, said pulley receiving said elastic cord to guide the movement of said elastic cord.

3. The exercise apparatus according to claim 2, wherein said elastic cord is connected to said base exteriorly of said pillar.

4. The exercise apparatus according to claim 1, wherein said exercise apparatus is moveable between a folded configuration and an unfolded configuration.

* * * * *